US008033036B1

(12) United States Patent
Turnbull

(10) Patent No.: US 8,033,036 B1
(45) Date of Patent: Oct. 11, 2011

(54) SNOWPLOW WHEEL KIT

(76) Inventor: Ron Turnbull, Montrose, CO (US)

( * ) Notice: Subject to any disclaimer, the term of this patent is extended or adjusted under 35 U.S.C. 154(b) by 0 days.

(21) Appl. No.: 12/611,092

(22) Filed: Nov. 2, 2009

Related U.S. Application Data

(60) Provisional application No. 61/110,085, filed on Oct. 31, 2008.

(51) Int. Cl.
*E01H 5/06* (2006.01)

(52) U.S. Cl. ..... 37/270

(58) Field of Classification Search ..... 37/270, 37/266, 263, 231–233, 271; 172/811–817; 16/18 R, 19, 45, 35 D, 35 R
See application file for complete search history.

(56) References Cited

U.S. PATENT DOCUMENTS

| | | | | | |
|---|---|---|---|---|---|
| 1,536,172 | A | * | 5/1925 | Webb | 37/281 |
| 1,591,830 | A | * | 7/1926 | Hughes | 37/277 |
| 1,728,032 | A | * | 9/1929 | Bising | 37/232 |
| 2,061,585 | A | * | 11/1936 | Meyer | 37/233 |
| 2,094,515 | A | * | 9/1937 | Abbe | 37/232 |
| 2,337,434 | A | * | 12/1943 | Washbond | 37/233 |
| 2,420,591 | A | * | 5/1947 | Frame et al. | 37/232 |
| 2,513,231 | A | * | 6/1950 | Bourne | 37/271 |
| 2,620,612 | A | * | 12/1952 | De Eugenio | 56/11.6 |
| 3,266,050 | A | * | 8/1966 | Reeder | 172/26 |
| 3,270,367 | A | * | 9/1966 | Loos | 16/19 |
| 3,466,766 | A | * | 9/1969 | Kahlbacher | 37/233 |
| 3,545,109 | A | * | 12/1970 | Boschung | 37/233 |
| 3,793,752 | A | * | 2/1974 | Snyder | 37/234 |
| 4,259,794 | A | * | 4/1981 | Rath | 37/233 |
| 4,905,387 | A | * | 3/1990 | Street | 37/271 |
| 5,251,390 | A | * | 10/1993 | Wong | 37/231 |
| 5,485,690 | A | * | 1/1996 | MacQueen | 37/271 |
| 5,806,214 | A | * | 9/1998 | Behrens et al. | 37/231 |
| 6,050,008 | A | * | 4/2000 | Doornek et al. | 37/231 |
| 6,094,846 | A | * | 8/2000 | Feller | 37/270 |
| 2010/0088930 | A1 | * | 4/2010 | Brame et al. | 37/231 |

FOREIGN PATENT DOCUMENTS

| | | | |
|---|---|---|---|
| CA | 2316150 | * | 5/2001 |
| CA | 2436616 | * | 2/2005 |
| JP | 11158830 A | * | 6/1999 |
| JP | 2001317022 A | * | 11/2001 |

* cited by examiner

*Primary Examiner* — Robert E Pezzuto
(74) *Attorney, Agent, or Firm* — Crossley Patent Law; Mark A. Crossley

(57) ABSTRACT

The present snowplow wheel kit converts a standard snowplow for use on unimproved surfaces. The snowplow wheel kit is designed to support the weight of the snowplow blade on swiveling wheel assemblies which are mounted to the rear of the snowplow blade and have the ability to turn in all directions. The tires ride on top of the unimproved surface, allowing the edge of the snowplow blade to travel just above the ground surface, thus removing the snow without the blade coming in direct contact with the soft underlying surface. The swivel feature of the wheel assemblies allows the blade to travel over the surface smoothly while maintaining the desired height of the blade edge from the surface. In addition, this feature allows for the plow blade to be fully functional when "back-plowing", using the rear of the plow blade to drag snow while the vehicle is moving rearward.

3 Claims, 11 Drawing Sheets

SNOWPLOW WHEEL KIT

BACKGROUND OF THE INVENTION

The present snowplow wheel kit converts a standard snowplow for use on unimproved surfaces. The conventional contractor-grade snowplow, being approximately 10 feet wide and weighing in the area of 1,000 pounds, is designed to scrape snow from a hard-finish surface by using the weight of the blade assembly to apply direct pressure to the hard surface. This process allows the blade edge to move across the hard surface, removing the snow from that surface. Adjustment of blade height above the hard surface is achieved on conventional snowplow blades by the use of metal shoes or skid plates attached to the rear of the blade assembly, supporting the weight of the snowplow blade and holding the blade edge above the surface being plowed.

When removing snow from unimproved surfaces such as dirt or gravel, the snowplow blade tends to dig into the soft surface and pushes the surface material along with the snow. This method does not allow for the removal of snow without also removing the surface material beneath the snow. The use of adjustable shoes or skid plates mounted on the rear of the snowplow blade only digs further into the unimproved surface or soft material to remove more of the base along with the snow.

The present Snowplow Wheel Kit is designed to address the foregoing problems by providing multi-directional swiveling wheel assemblies mounted to a snowplow blade rear end thereby allowing the blade to travel over unimproved surfaces smoothly while maintaining the desired height of blade edge from the surface and further allowing back-plowing.

SUMMARY OF THE INVENTION

The present snowplow wheel kit converts a standard snowplow for use on unimproved surfaces. The snowplow wheel kit is designed to support the weight of the snowplow blade on swiveling wheel assemblies which are mounted to the rear of the snowplow blade and have the ability to turn in all directions. The tires ride on top of the unimproved surface, allowing the edge of the snowplow blade to travel just above the ground surface, thus removing the snow without the blade coming in direct contact with the soft underlying surface. The swivel feature of the wheel assemblies allows the blade to travel over the surface smoothly while maintaining the desired height of the blade edge from the surface. In addition, this feature allows for the plow blade to be fully functional when "back-plowing", using the rear of the plow blade to drag snow while the vehicle is moving rearward.

The height of the snowplow wheel kit is adjustable to provide for any underlying surface conditions. This concept also allows for the plow to be used on improved surfaces by simply adjusting the wheel height to allow the snowplow's blade edge to come into contact with the hard surface.

The present snowplow wheel kit offers an economical and efficient conversion for the standard contractor-style snowplow blade used for commercial and residential snow removal where dirt, gravel and unimproved surfaces exist.

In this respect, before explaining the current embodiments of the improved snowplow wheel kit in detail, it is to be understood that the snowplow wheel kit is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved snowplow wheel kit. It is therefore important that the claims be regarded as including such equivalent constructions insofar as they do not depart from the spirit and scope of the snowplow wheel kit. It is also to be understood that the phraseology and terminology employed herein are for purposes of description and should not be regarded as limiting.

BRIEF DESCRIPTION OF THE DRAWINGS FIGURES

DETAILED DESCRIPTION OF THE PREFERRED EMBODIMENT

Figure 1:
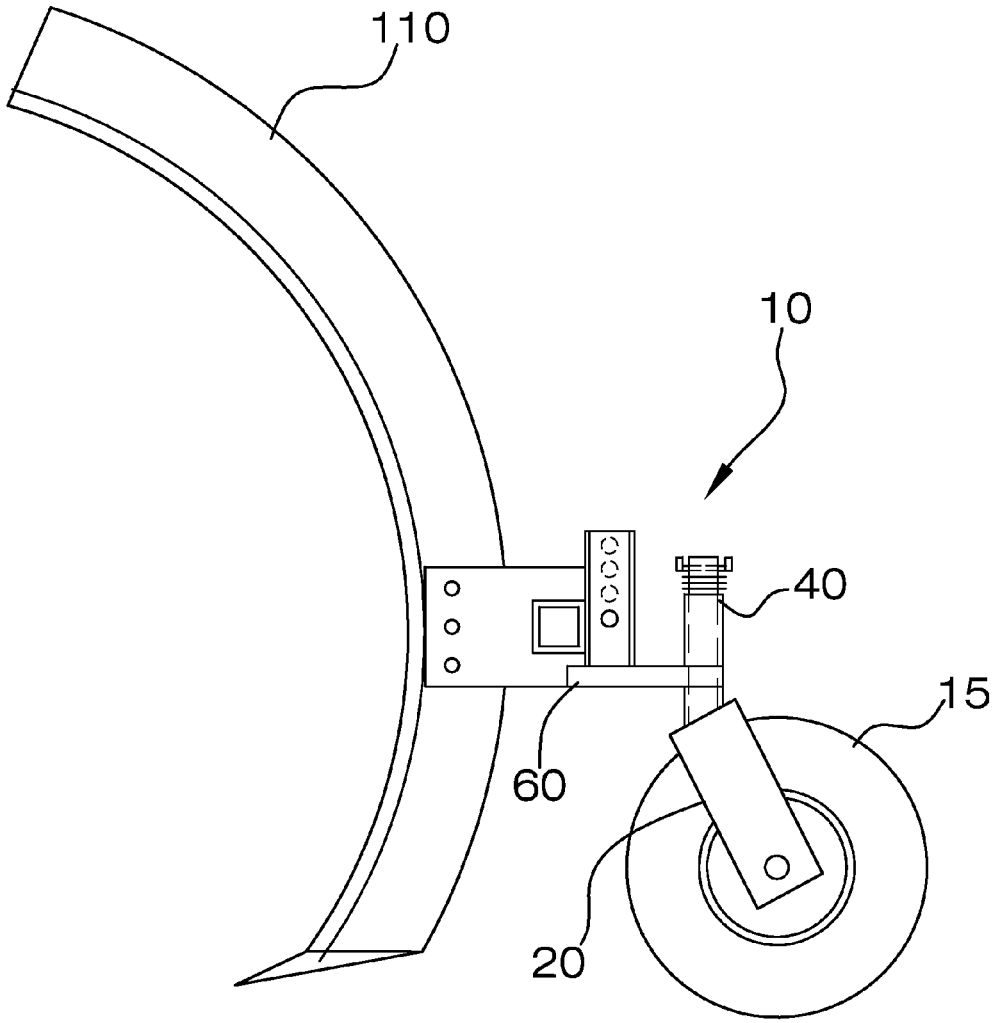
FIG. 1 is a side elevation view installed on a snowplow blade.
Figure 2:
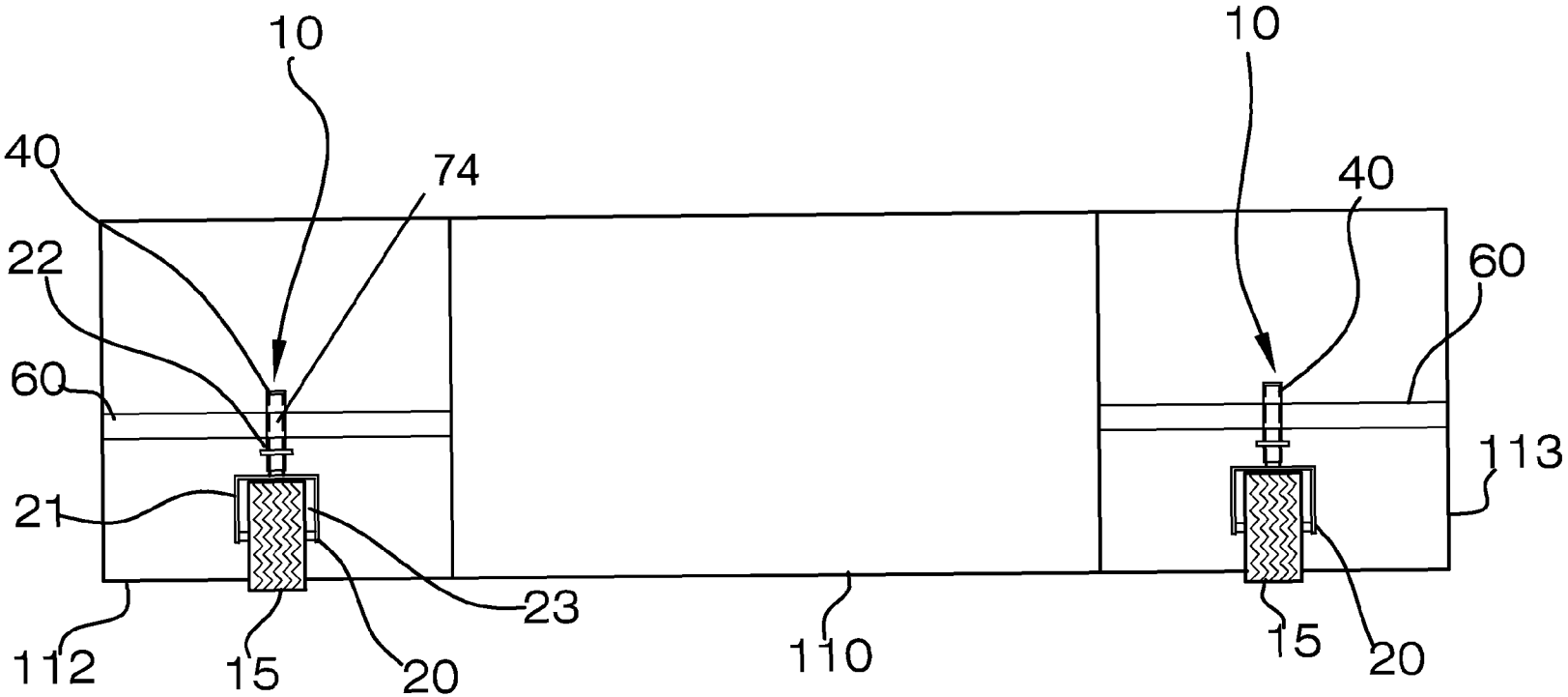
FIG. 2 is a front elevation view illustrating wheel assembly inserted into a receiver mount and installed on a snowplow blade.
Figure 3:
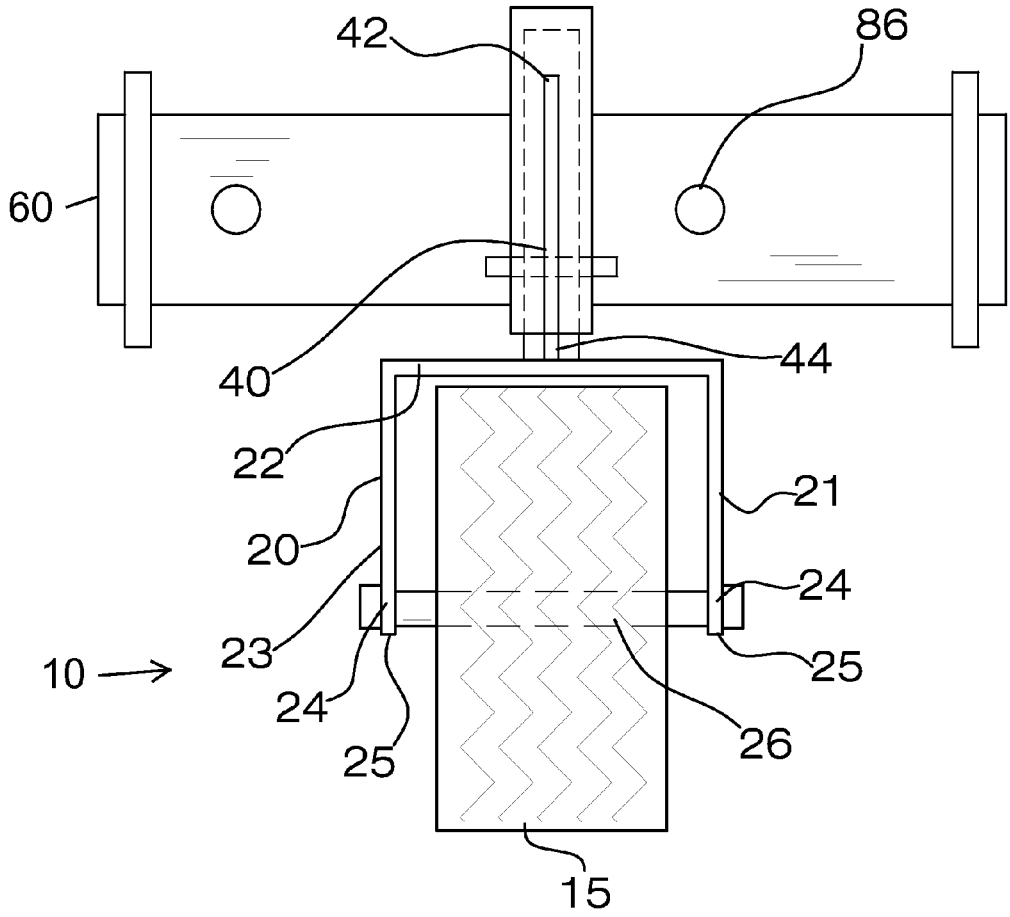
FIG. 3 is a detail front elevation view of a wheel assembly and castering assembly installed into a receiver mount and installed on a snowplow blade.
Figure 4:
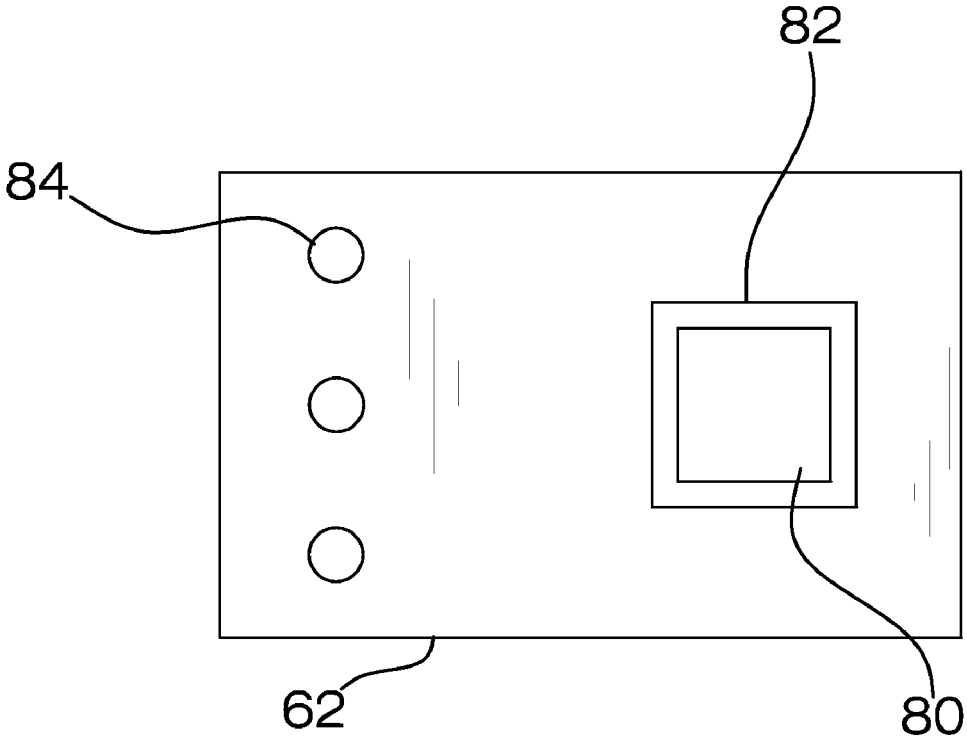
FIG. 4 is a front elevation view of a left side mounting plate and receiver bar in an alternative embodiment.
Figure 5:
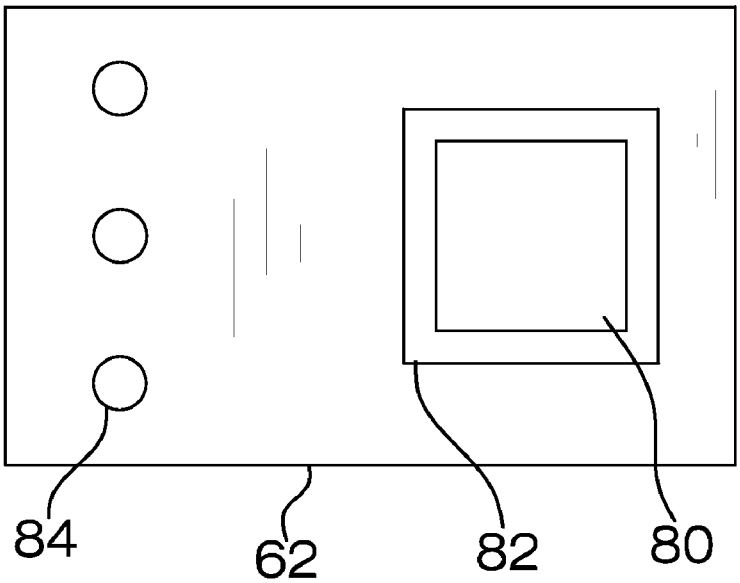
FIG. 5 is a front elevation view of a right side mounting plate and receiver bar in an alternative embodiment.
Figure 6:
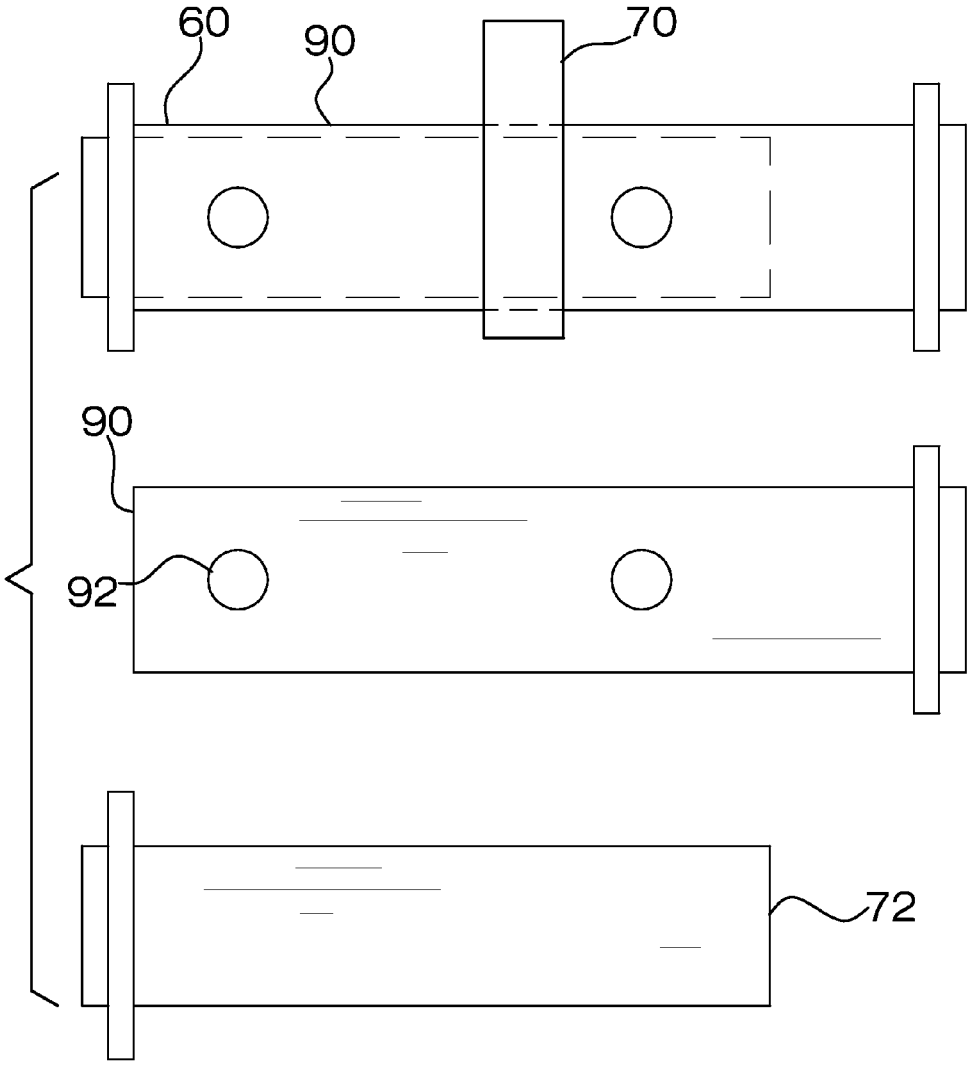
FIG. 6 is a front elevation view of an adjustable dimension receiver mount in an alternative embodiment.
Figure 7:
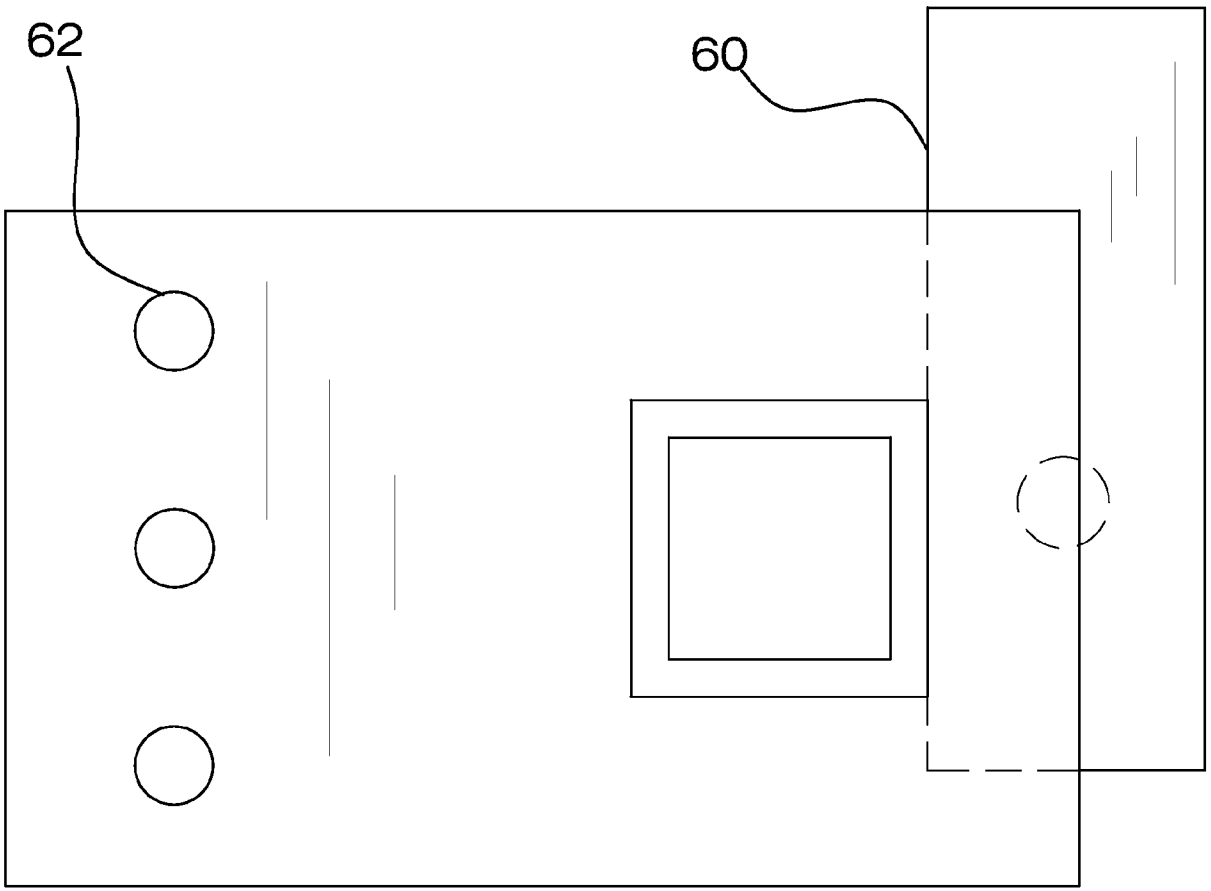
FIG. 7 is a side elevation view of a receiver mount.
Figure 8:
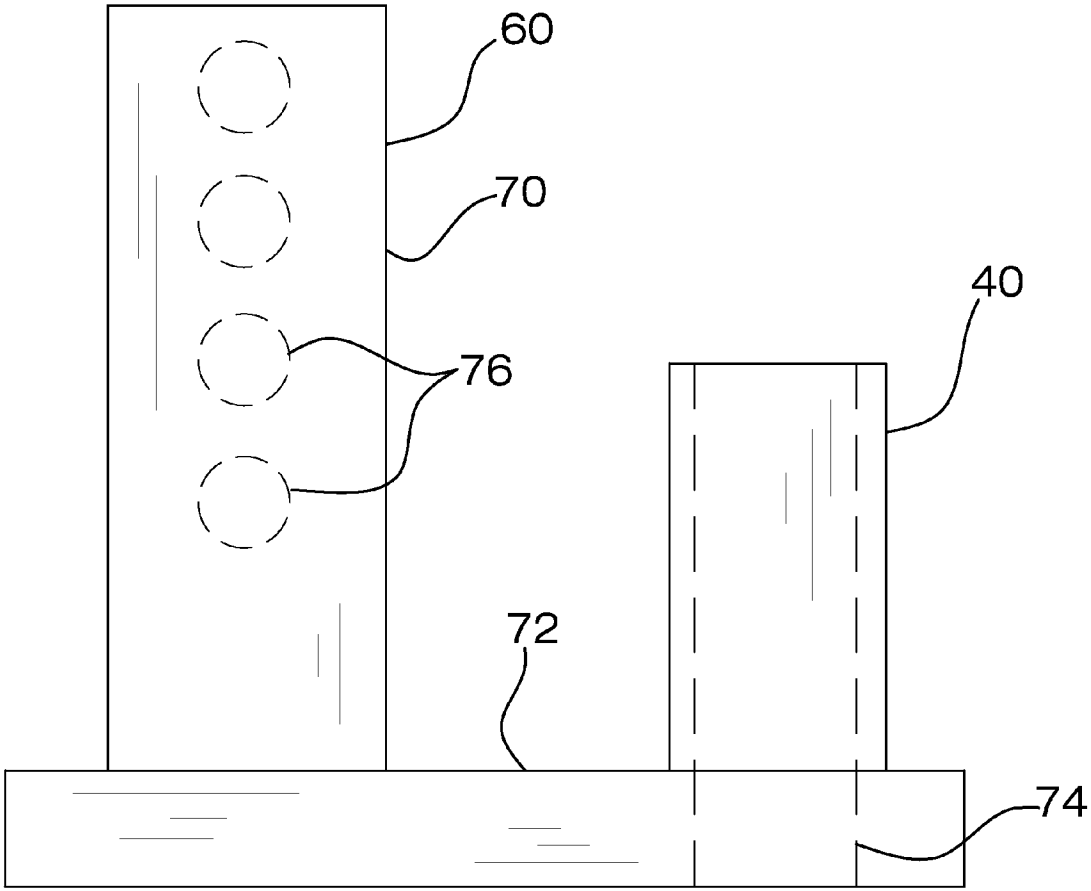
FIG. 8 is a side elevation view of an adjustable wheel height assembly.
Figure 9:
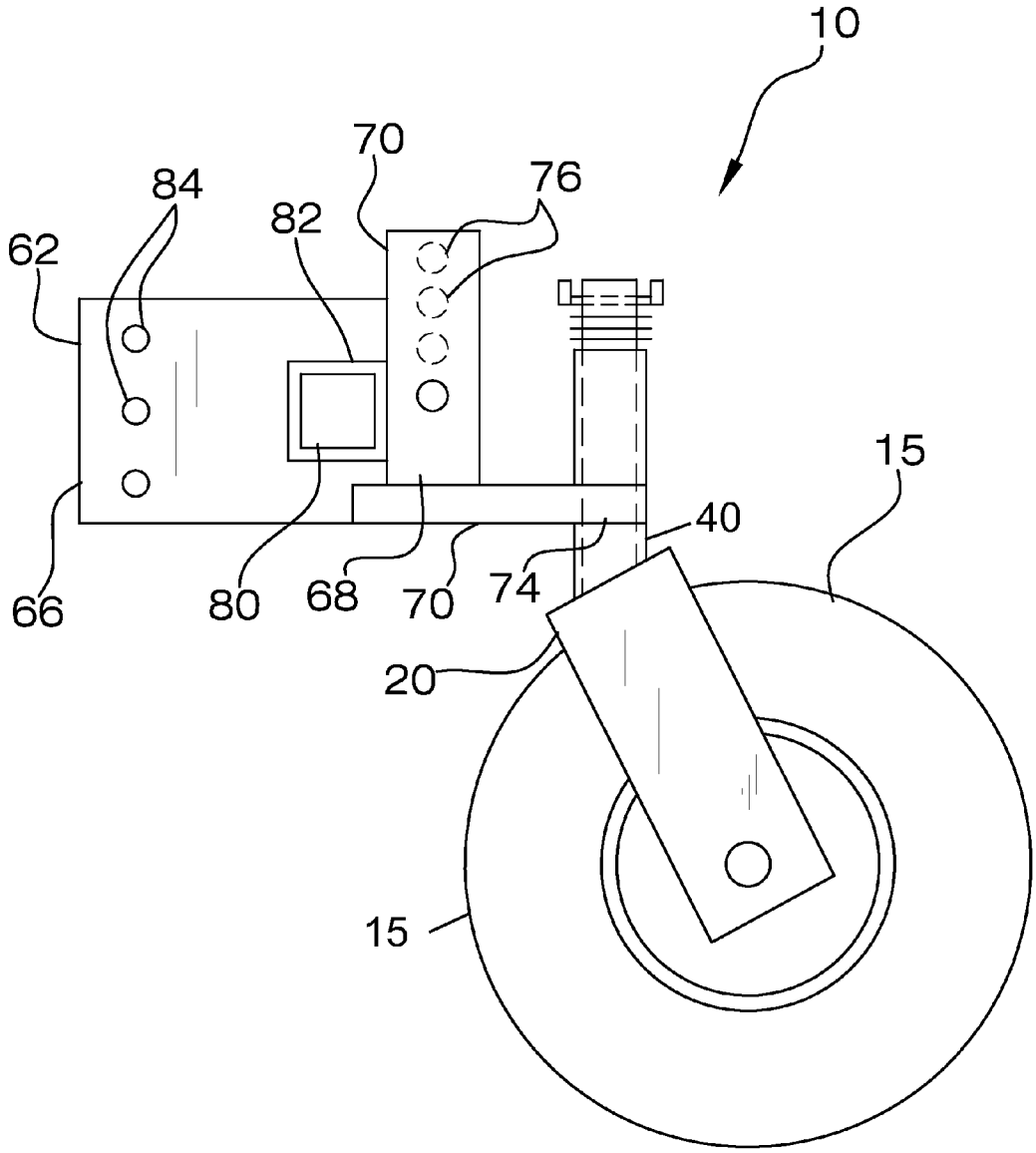
FIG. 9 is a side elevation view of the present snowplow wheel kit.
Figure 10:
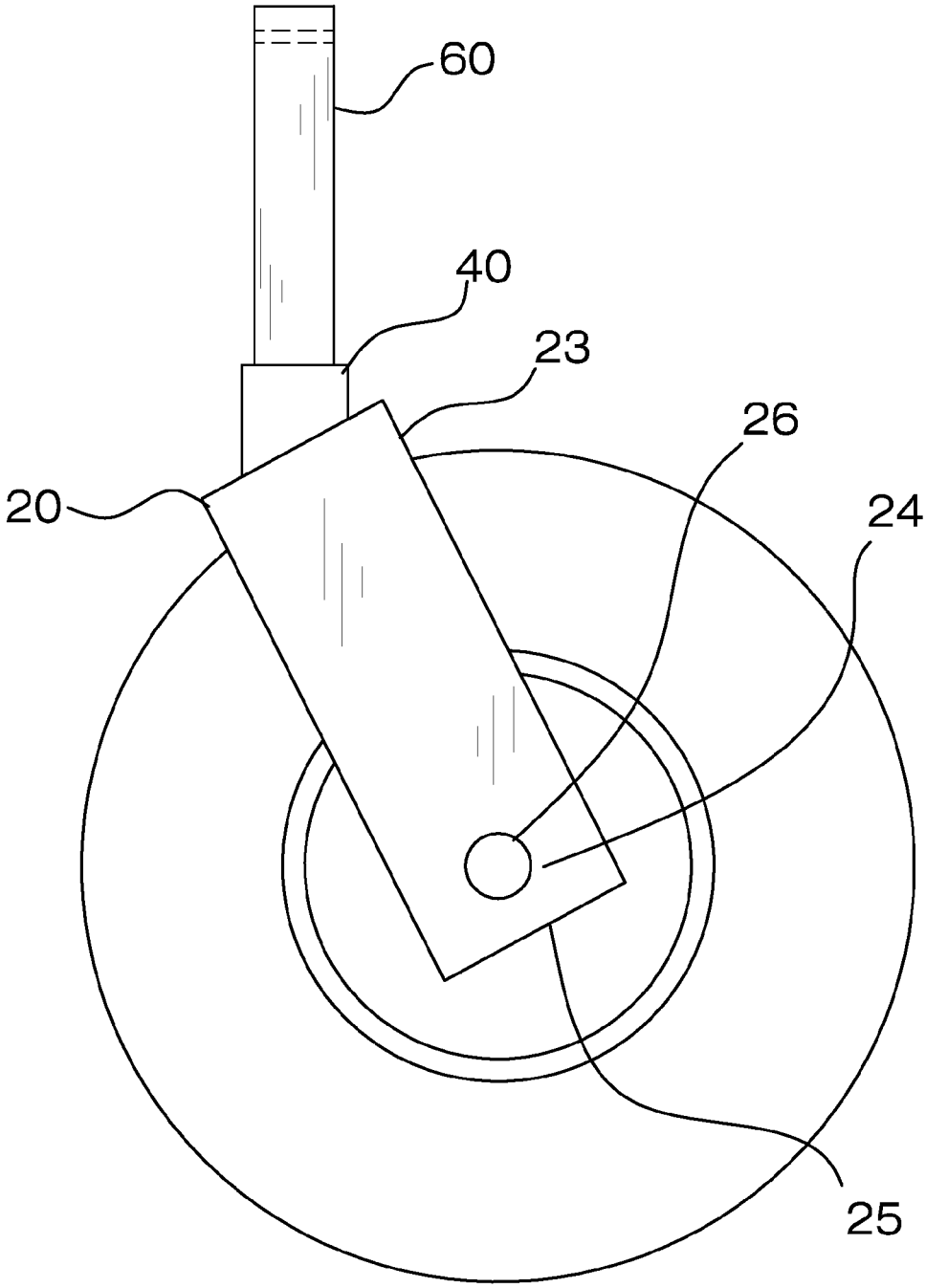
FIG. 10 is a side elevation view of a wheel caster assembly.
Figure 12:
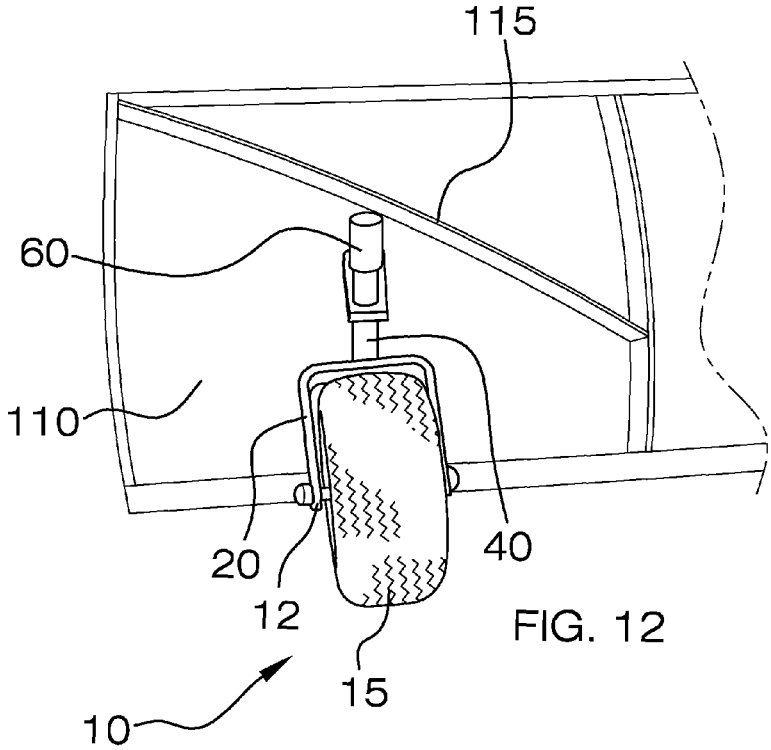
FIG. 12 is an in-use left side isometric view of the present kit installed on a snowplow blade connected to a truck front end
Figure 11:
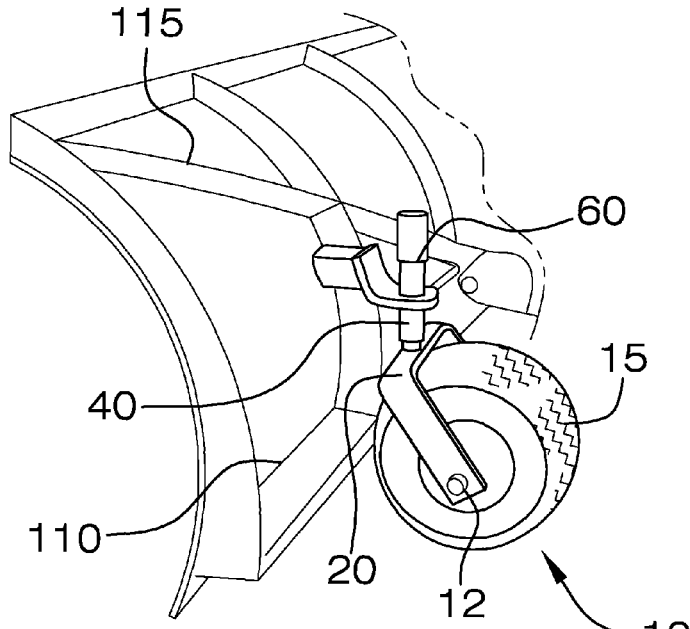
FIG. 11 is an in-use front isometric view of the present kit installed on a snowplow blade connected to a truck front end.
Figure 13:
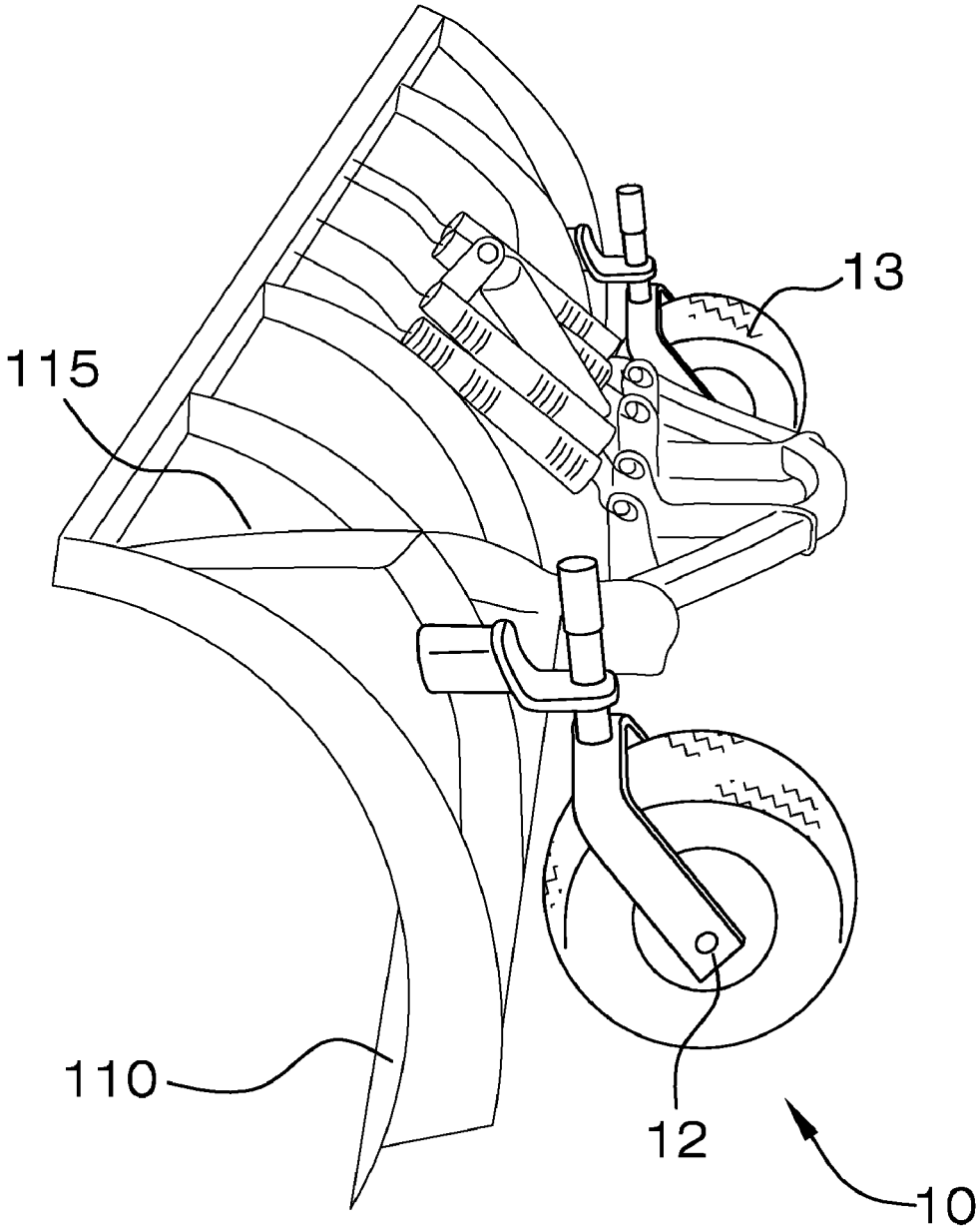
FIG. 13 is an in-use side elevation view of the present kit installed on a snowplow blade connected to a truck front end.

With reference now to the drawings, and in particular FIGS. 1 through 13 thereof, the principles and concepts of the snowplow wheel kit generally designated by the reference number 10 will be described.

Referring to FIGS. 1 through 13, the present snowplow wheel kit 10 converts a standard snowplow 100 for use on unimproved surfaces by providing a left unit 12 and right unit 13 identical to the left unit 12, each unit 12, 13 having a wheel 15, a castering assembly 20 pivotally engaging the wheel 15, an adjustable elongated insert 40 extending upwardly from the castering assembly 20, and an adjustable receiver mount 60 mounted to a snowplow blade 110. The left unit 12 and the right unit 13 are mounted to a right front side 112 and a left front side 113 of a snowplow blade 110. The snowplow blade 110 has a plurality of ribs 115.

The castering assembly 20 provides a U-shaped frame 19 having a right section 21, a center section 22, and a left section 23. The right section 21 and the left section 23 each have an aperture 24 centered therein a bottom edge 25 and an axle 26 continuously from the aperture 24 of the right section 21 to the aperture 24 of the left section 23. The wheel 15 rotatingly engages the axle 26 of the castering assembly 20. An elongated cylindrical insert 40 having a top portion 42 and a bottom portion 44 is provided. The bottom portion 44 of the insert 40 is permanently affixed to the center section 22.

The receiver mount 60 has a base section 62 and an L-shaped adjustment section 64. The base section 62 has a first end 66 and a second end 68. The first end 66 of the base section 62 is mounted to a snowplow blade 110 rib 115 as illustrated. The L-shaped adjustment section 64 has an upper portion 70 and a lower portion 72. The upper portion 70 is perpendicularly slidingly engages the base section 62 second end 68. The upper portion 70 has a plurality vertically-aligned equidistantly-positioned holes 76 centered therein. A securement means is provided to secure the upper portion 70 through one of the holes 76 to the second end 68 of the base section 62 at a desired height. The lower portion 72 has an opening 74. The insert 40 slidingly engages the opening 74. The insert 40 top portion 42 has a locking mechanism 46 whereby the insert 40 slidingly engages the lower portion 72 opening 74 of the adjustment section 64 for height adjustment.

Another embodiment provides a receiver bar 80 that slidingly engages a through plate 82 through the receiver mount 60 base section 62 and that locks into position with a locking means 86 through circular cut-throughs 84 in the base 62.

Yet another embodiment provides a female sleeve 90 that slidingly engages the base section 62 of the receiver mount 60 and is locked into place with a securing means 92.

What is claimed is:

1. A snowplow wheel kit in combination with a standard snowplow comprising:

a snowplow blade;

a left unit and a right unit, each of the left unit and the right unit comprising:

a wheel;

a castering assembly comprising:

a U-shaped frame having a right section, a center section, and a left section, wherein each of the right section and the left section have an aperture centered therein, a bottom edge, and an axle continuously disposed from the right section aperture to the left section aperture;

wherein each wheel rotatingly engages the axle;

an elongated cylindrical insert having a top portion and a bottom portion, the bottom portion permanently affixed to the center section of the frame, the top portion having a locking mechanism;

wherein the castering assembly pivotally engages the wheel;

an adjustable elongated insert extending upwardly from the castering assembly;

wherein the left unit and the right unit mount to a respective right front side and a left front side of the snowplow blade, the snowplow blade having a plurality of ribs;

an adjustable receiver mount mounted to the snowplow blade, the receiver mount comprising:

a base section having a first end and a second end, wherein the first end mounts to a snowplow blade rib;

an L-shaped adjustment section having an upper portion and a lower portion, wherein the upper portion perpendicularly slidingly engages the base section second end, further wherein the upper portion has a plurality vertically-aligned equidistantly-positioned holes centered therein;

a securement member adjustably slidingly engaging an upper portion hole and the base section second end at a desired height;

an opening disposed within the lower portion, wherein the insert slidingly engages the opening;

wherein the insert slidingly engages the lower portion opening of the adjustment section whereby the snowplow blade slidingly engages an amount of snow disposed on unimproved surfaces.

2. The snowplow wheel kit of claim 1 further comprising:

a through plate disposed through the receiver mount base section;

a receiver bar slidingly engaging the through plate;

a plurality of circular cut-throughs disposed in the base; and a locking mechanism releasably engaging the receiver bar and the cut-throughs.

3. The snowplow wheel kit of claim 1 further comprising:

a female sleeve that slidingly engages the base section of the receiver mount; and a securing mechanism releasbly engaging the female sleeve.

* * * * *